US006345014B1

(12) United States Patent
Edouard et al.

(10) Patent No.: US 6,345,014 B1
(45) Date of Patent: Feb. 5, 2002

(54) COLLAPSIBLE ANNULAR ACOUSTIC TRANSMISSION ANTENNA

(75) Inventors: Marc Edouard, Chateauneuf de Grasse; Gilles Lubrano, Mougins; Vito Suppa, Roquefort les Pins; Yves Lagier, Sophia Antipolis; Jacques Brun, Le Rouret; Jean-Paul Guido, Coursegoules, all of (FR)

(73) Assignee: Thomson Marconi Sonar S.A.S., Sophia Antipolis (FR)

( * ) Notice: Subject to any disclaimer, the term of this patent is extended or adjusted under 35 U.S.C. 154(b) by 0 days.

(21) Appl. No.: 09/623,851

(22) PCT Filed: Mar. 9, 1999

(86) PCT No.: PCT/FR99/00523

§ 371 Date: Sep. 11, 2000

§ 102(e) Date: Sep. 11, 2000

(87) PCT Pub. No.: WO99/46059

PCT Pub. Date: Sep. 16, 1999

(30) Foreign Application Priority Data

Mar. 10, 1998 (FR) ..... 98 02912

(51) Int. Cl.[7] ..... B06B 1/06
(52) U.S. Cl. ..... 367/165
(58) Field of Search ..... 367/153, 155, 367/157, 163, 165, 173; 310/337; 73/861.18

(56) References Cited

U.S. PATENT DOCUMENTS 3,243,767 A * 3/1966 Kending et al.
3,559,162 A * 1/1971 Granfors
3,757,888 A 9/1973 Lagier et al.
4,029,141 A 6/1977 Ferrari et al.
4,068,209 A 1/1978 Lagier
4,279,025 A 7/1981 Suppa
4,295,211 A 10/1981 Suppa et al.
4,380,440 A 4/1983 Suppa
4,712,201 A 12/1987 Lagier
4,883,143 A 11/1989 Lagier
5,144,597 A 9/1992 Lagier et al.
5,431,058 A 7/1995 Lagier et al.
5,630,837 A * 5/1997 Crowley
5,795,203 A 8/1998 Suppa et al.
6,035,524 A 3/2000 Suppa et al.
6,046,962 A 4/2000 Suppa et al.
6,065,349 A * 5/2000 Edouard et al.

* cited by examiner

*Primary Examiner*—Daniel T. Pihulic
(74) *Attorney, Agent, or Firm*—Oblon, Spivak, McClelland, Maier & Neustadt, P.C.

(57) ABSTRACT

Acoustic transmitting antennas in the form of circular rings. Several circular rings which can be dismantled of a known type are superimposed in a stack. The stack is terminated at each end by two profiled annuli. The threaded tie-rods traverse the stacks of the pre-stressing keys of the rings by the intermediary of holes drilled in these keys. The threaded tie-rods make it possible to ensure the holding of the assembly. Two jackets, inside and outside, made of rubber, cover the inside and outside faces of the stack and are anchored in grooves formed in the profiled annuli. Thereby, annular transmitting antennas can be provided which can be dismantled entirely and whose active mass to inactive mass ratio is particularly large.

7 Claims, 2 Drawing Sheets

COLLAPSIBLE ANNULAR ACOUSTIC TRANSMISSION ANTENNA

BACKGROUND OF THE INVENTION

1. Field of the Invention

The present invention relates to acoustic transmitting antennas which are in the shape of a ring and which can be dismantled. Such antennas are particularly useful for long range low frequency sonars.

2. Discussion of the Background

From the patent application Ser. No. 09/415,587 lodged by the company THOMSON-CSF on Dec. 23, 1994 under the title "Pre-stressed ring-shaped acoustic transducer" and published on Jun. 4, 1996 under U.S. Pat. No. 2,728,755 there is known a transducer of this type essentially characterized in that the transmitting piezoelectric ring is produced in the form of segments placed inside a metal or composite annulus forming a hoop. These segments are separated from each other by metal parts in the shape of wedges. A screw-based device makes it possible to move the wedges towards the centre of the ring, which tends to separate the segments from one another. The segments are thus pressed against the hooping annulus and a pre-stressing of all the segments is obtained. A major advantage of this construction is that the device is thereby made such that it can be entirely and very easily dismantled, in order to be able, for example, to replace a defective part. Furthermore, it is very easily possible to adjust the pre-stressing by adjusting the screws until the desired characteristics, which are then continuously measured during this action, are obtained.

Such a transmitting transducer can easily be made with a diameter situated within a relatively wide range of dimensions. It is however more difficult, for both mechanical and acoustic reasons, to manufacture a transducer of this type with a relatively large height.

In order to obtain a sufficient transmitting power, which is known to be necessary in the low frequency ranges to which this type of transducer applies more particularly, it is therefore necessary to use several separate transducers of the same type. This can be done, for example, by fixing the transducers on a common frame which holds them at a suitable distance in order to obtain the desired acoustic characteristics. The presence of such a frame of course gives rise to an increase in the inactive mass with respect to the active mass constituted by the transducer elements themselves.

In certain cases, for a hull sonar for example, this does not present very big disadvantages. On the contrary, in other cases, in particular when the transmitting antenna is placed in a body towed by a boat, it is necessary to have the lowest possible weight in order to consequently reduce the mass of the towing cable both to reduce the drag and to facilitate the handling of this cable.

SUMMARY OF THE INVENTION

In order to be able to reduce this inactive mass, the invention proposes an annular acoustic transmitting antenna which can be dismantled, of the type comprising at least one pre-stressed ring formed from a set of piezoelectric segments grouped in order to form substantially identical sectors, end pieces fixed to these sectors in order to delimit wedge-shaped gaps between them, and wedge-shaped tightening keys adapted to these gaps and placed in them, a shaping hoop allowing all the sectors to be held, and means for allowing the tightening keys to slide towards the inside of the ring for pre-stressing the segments against the hoop, characterized in that it comprises a set of substantially identical rings superimposed upon each other in such a way that the tightening keys are facing each other, two profiled annuli of the same diameter as that of the pre-stressed rings and placed respectively at the two ends of the stack, and a set of fixing tie-rods traversing respectively the groups of superimposed keys by the intermediary of longitudinal holes bored in these keys in order to be fixed to the profiled annuli in order to press the rings against each other.

According to another characteristic, it comprises two jackets made of elastic material respectively covering the outside and inside faces of the cylinder formed by the stack of rings, and each comprising rims which anchor in peripheral grooves formed in the faces of the profiled annuli located on the other side from the faces of these annuli which bear on the rings.

According to another characteristic it furthermore comprises two ring-shaped flanges respectively fixed on the said surfaces of the profiled annuli in order to maintain the said rims in the said peripheral grooves.

According to another characteristic, it comprises insulating rings inserted between the superimposed rings.

According to another characteristic, it furthermore comprises rings made of an elastic material interposed between the profiled annuli and the insulating rings located under these annuli in order to decouple the rings acoustically from the structure supporting them.

According to another characteristic, the fixing tie-rods form screws whose heads bear on the outside face of one of the profiled annuli and whose other ends are threaded and screw into blind tapped holes, bored on the inside face of the other profiled annulus.

According to another characteristic, the feed connector of the antenna and the latter's inflation nozzle are fixed on elastic supports which are themselves fixed on the outside surface of the inside protective jacket of the antenna.

BRIEF DESCRIPTION OF THE DRAWINGS

Other features and advantages of the invention will appear clearly in the following description, given by way of non-limiting example with reference to the accompanying figures which show.

DESCRIPTION OF THE PREFERRED EMBODIMENTS

Figure 1:
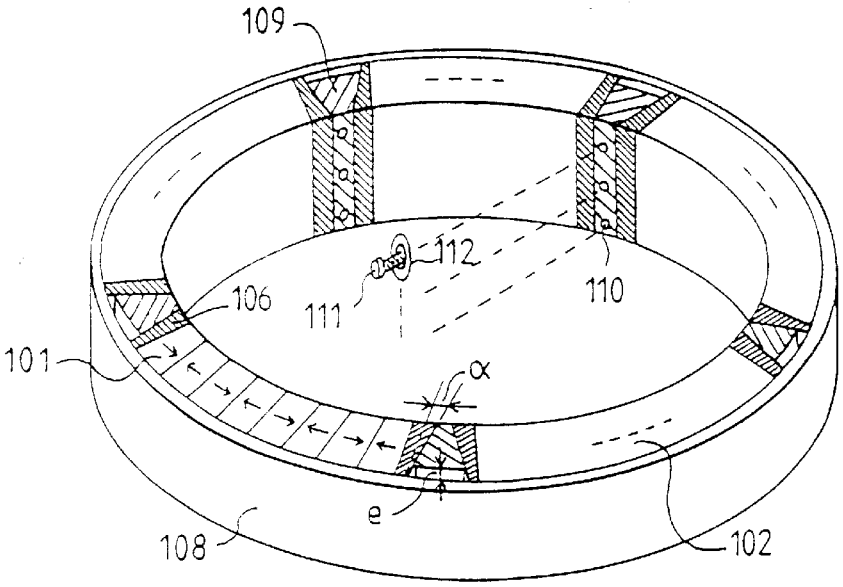
in FIG. 1, an elementary ring, according to the prior art.

In FIG. 1 there has been shown an elementary ring making it possible to obtain by assembly an antenna according to the invention. This ring conforms with the one described in the patent application quoted above.

The active elements of this ring are formed by a set of trapezoidal segments 101 made of piezoelectric ceramic disposed against one another with alternating polarizations in order to constitute the sectors 102 of a circular ring.

These sectors are assembled inside a hoop 108 which makes it possible hold them in order to obtain the shape of the circular ring intended to transmit acoustic waves in a radially symmetrical manner. In order to maintain these sectors in position in the hoop, there has been placed between their ends assemblies formed by two wedges 106 separated by a key 109. The wedges 106 have their large bases facing the inside of the ring and their small bases facing the hoop. The keys 109 have their small bases facing the inside of the ring and their large bases facing the hoop. These keys 109 comprise on their small bases tapped holes 110 in which are screwed screws 111 fitted with washers 112. These washers are sufficiently wide to protrude beyond the small bases of the keys 109 and bear against the large bases of the wedges 106. In this way, by screwing the screws 111 the keys 109 are made to slide towards the inside of the ring, whilst maintaining the wedges 106 pressed against the hoop 108. The wedges 106 therefore separate by compressing the segments 102 and pressing the latter against the inside face of the hoop 108.

Figure 2:
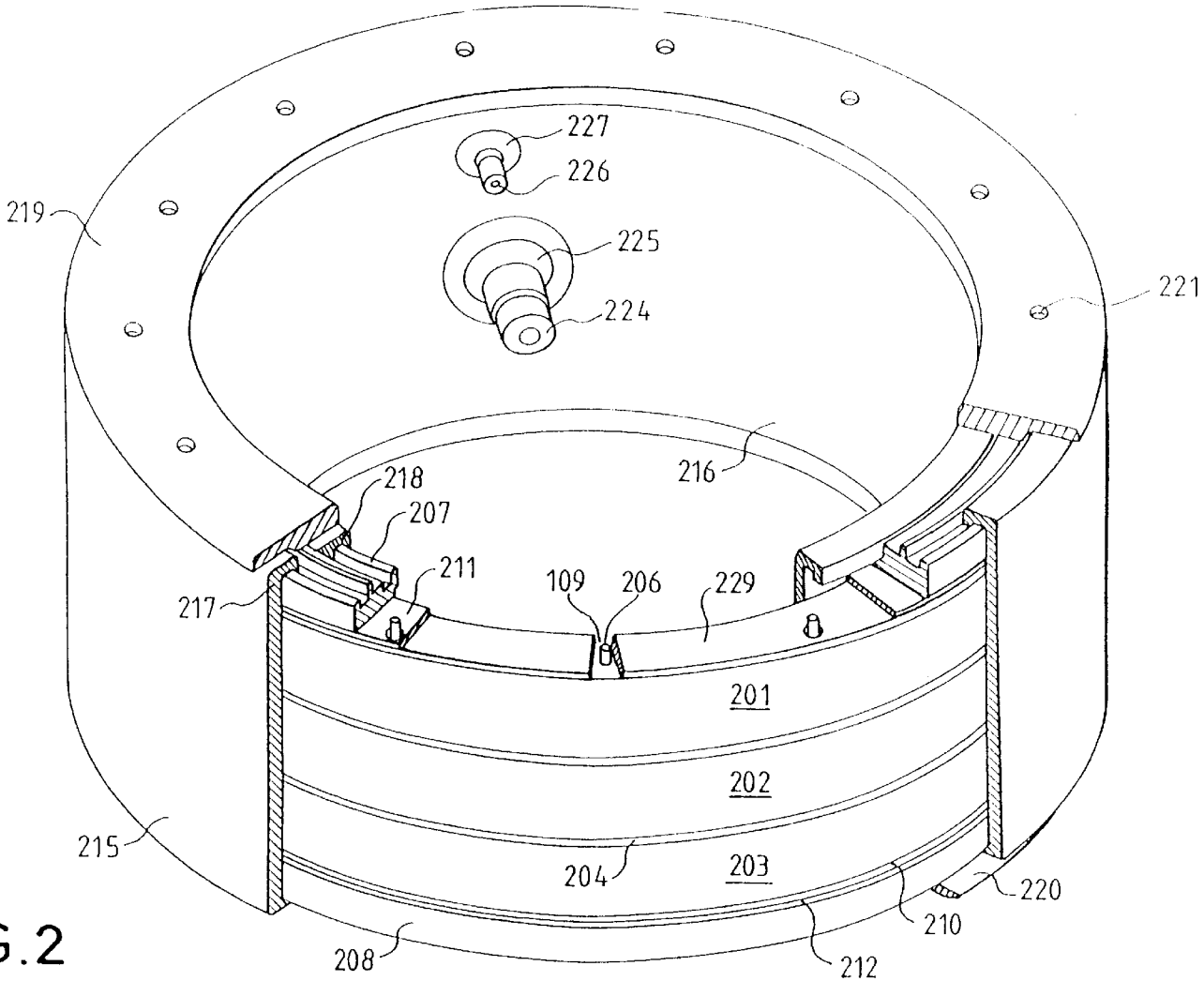
in FIG. 2, a partially sectional view of an antenna according to the invention.

According to the invention, a certain number of rings such as the one described above are placed one above the other in order to obtain a transmitting cylinder whose transmitting characteristics, the power available without deterioration in particular, are those desired. In the example shown in FIG. 2, three rings 201 to 203 have been used.

In order to ensure the electrical insulation between these rings, whilst ensuring a correct acoustic coupling, there has been interposed between them insulating layers 204 manufactured from a material having the necessary characteristics, for example a plastic material known by its registered trade name "DELRIN". A thickness of about 1 mm of such a material makes it possible to obtain the desired characteristics.

The rings are placed one upon the other in such a way that the active segments 102 are superimposed in continuity with one another, which means that the wedges 106 and the keys 109 are themselves superimposed with respect to each other.

Figure 3:
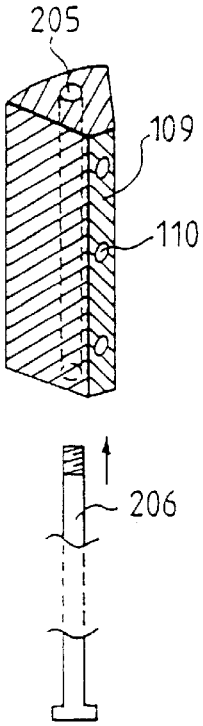
in FIG. 3, a perspective view of a tightening key of a ring and of an assembly tie-rod which is associated with it; and in FIG. 4, a cross-sectional view of two profiled end annuli allowing the assembly of the elementary rings.
Figure 4:
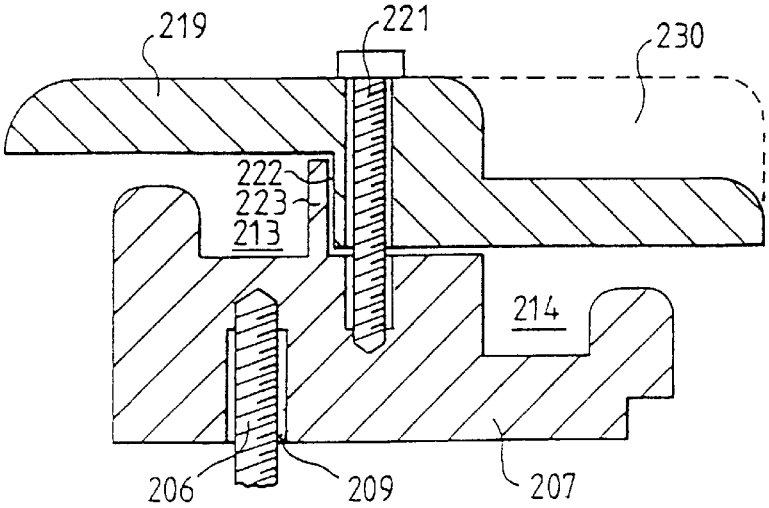

In order to assemble these rings together, there have been formed in the keys 109 longitudinal holes 205, one per key, which connect the upper face and the lower face of these keys, as shown in FIG. 3. The tapped holes 110 are of a sufficiently small depth not to open into the hole 205, in order not to risk interfering with the assembly described below.

The holes 205 of each of the superimposed keys are therefore in alignment with one another, which makes it possible to pass assembly tie-rods 206 through them, which makes it possible to join the rings firmly together.

In order to do this, two annuli 207 and 208 are used whose faces in contact with the transmitting rings 201 to 203 are flat and whose faces located on the other side are machined with a profiled shape with grooves whose function will be described below. In a preferred embodiment, the lower profile 208 is pierced with holes which are facing the holes 205 of the ring 203, in order to make it possible to pass through them the tie-rods 206 which are in the form of screws whose heads bear on the outside face of this profile 208.

The other ends of the tie-rods 206 are threaded and screw into blind tapped holes 209 bored in the profile 207 plumb with the tie-rods 206. This method of construction is the simplest, but it would be possible to use other variants such as, for example, a hole opening on the upper face of the profile 207 and a nut screwed on the screw 206, or rods threaded at both ends traversing the two profiles 207 and 208 and provided at each of their ends with nuts intended to ensure the fixing of the assembly.

In this embodiment, in order to insulate the segments of the profiles 207 and 208 there are used, from the electrical point of view, rings 209 and 210 which are identical to the rings 204 and, from the acoustic point of view, rings 211 and 212 made of relatively thick elastic material, for example of 4 mm thick rubber, which separate these profiles from the transmitting piezoelectric segments. In the figure, these rings have been shown cut in order to show the superimposition of the layers, in particular at the level of the key 109. A single rubber ring could possibly be used by selecting a sufficiently insulating rubber variety.

The profiles 207 and 208 therefore have a flat lower face making it possible to press on the rubber rings and an upper face having outer 213 and inner 214 peripheral grooves.

The outside and inside faces of this assembly are covered with two layers of rubber, 215 and 216 respectively, which form jackets intended to ensure the fluid-tightness of the stack with respect to external agents, in particular to the seawater in which the device must be immersed. At their ends, these jackets have rims 217 and 218, obtained for example by machining or by moulding, which lodge in the grooves 213 and 214 respectively. As a variant, it would be possible to use profiles having several successive grooves adapted to an appropriate moulding of the rims of the jackets in order to increase the length of the join between these rims and these grooves in order to obtain better fluid-tightness. The fluid-tightness is itself obtained by pressing the rims into the grooves by means of two fixing flanges, upper 219 and lower 220, in the shape of rings which are assembled on the profiles by screws 221. In this example embodiment, these flanges have a median shoulder 222 which bears against a median circular protrusion 223 formed on the top of the profiles and concentric with the groove 213, in such a way as to be able to centre each flange on the corresponding profile without difficulty, by fitting it in like a lid. As a variant, it is possible to machine the rings in order to eliminate the inner excess thickness 230, corresponding to the difference in height of the groove 314 with respect to the groove 215, in order to reduce the inactive weight of the assembly as much as possible.

In order to be able to feed the segments of the rings 201 to 203 with electrical excitation signals, a multi-wire connector 224 is used, which is placed in a fitting 225 made from the same material, rubber for example, as the inside jacket 216. This fitting is fixed on the outer face of this inner envelope in such as way as to protrude into the inside space of the transducer. The fixing is carried out by any known means of connecting parts made of material of this type, by vulcanization for example.

In the same way, a valve 226, allowing the filling of the inside space of the transducer with an appropriate fluid, oil for example, is fixed by means of a fitting 227 on the inner jacket 216.

In one embodiment of such a transmitting antenna, there has been assembled three rings, each of them comprising 14 segments and whose inside and outside diameters are substantially 450 and 600 mm. The active mass to total mass ratio of this device is greater than 75%, which is a particularly remarkable value. Furthermore, the antenna thus obtained, as can be observed, can be dismantled and reassembled entirely, which makes it possible to replace, easily and rapidly, a segment which may prove to be defective.

In order to fix the antenna on its support, the holding structure of a towed fish for example, one or other of the two flanges 219 and 220 is used. The layers of rubber 211 then make it possible to decouple the antenna acoustically from this structure.

What is claimed is:

1. Annular acoustic transmitting antenna which can be dismantled, of the type comprising at least one pre-stressed ring formed from a set of piezoelectric segments grouped in order to form substantially identical sectors, end pieces fixed to these sectors in order to delimit wedge-shaped gaps between them, and wedge-shaped tightening keys adapted to these gaps and placed in them, a shaping hoop allowing all the sectors to be held, and tightening means allowing the tightening keys to slide towards the inside of the ring for pre-stressing the segments against the hoop, characterized in that it comprises a set of substantially identical pre-stressed rings superimposed upon each other in such a way that the tightening keys are facing each other, two profiled annuli of the same diameter as that of the prestressed rings and placed respectively at the two ends of the stack, and a set of fixing tie-rods traversing respectively the groups of superimposed keys by the intermediary of longitudinal holds bored in these keys in order to be fixed to the profiled annuli in order to press the rings against each other.

2. Antenna according to claim 1, characterized in that it comprises two jackets made of elastic material respectively covering the outside and inside faces of the cylinder formed by the stack of rings, and each comprising rims which anchor in peripheral grooves formed in the faces of the profiled annuli located on the other side from the faces of these annuli which bear on the rings.

3. Antenna according to claim 2, characterized in that it furthermore comprises two ring-shaped flanges respectively fixed on the said surfaces of the profiled annuli in order to maintain the said rims in the said peripheral grooves.

4. Antenna according to claim 1, characterized in that it comprises insulating rings inserted between the superimposed rings.

5. Antenna according to claim 1, characterized in that it furthermore comprises rings made of an elastic material interposed between the profiled annuli and the insulating rings located under these annuli in order to decouple the rings acoustically from the structure supporting them.

6. Antenna according to claim 1, characterized in that the fixing tie-rods form screws whose heads bear on the outside face of one of the profiled annuli and whose other ends are threaded and screw into blind tapped holes, bored on the inside face of the other profiled annulus.

7. Antenna according to claim 1, characterized in that the feed connector of the antenna and the latter's inflation nozzle are fixed on elastic supports which are themselves fixed on the outside surface of the inside protective jacket of the antenna.

* * * * *